US007625518B2

(12) United States Patent
Pingel

(10) Patent No.: US 7,625,518 B2
(45) Date of Patent: Dec. 1, 2009

(54) SMELT SPOUT OPENING CLEANER, CLEANING HEAD AND APPARATUS

(75) Inventor: Kenneth A. Pingel, Hillsboro, OR (US)

(73) Assignee: Clyde Bergemann, Inc., Portland, OR (US)

( * ) Notice: Subject to any disclaimer, the term of this patent is extended or adjusted under 35 U.S.C. 154(b) by 0 days.

(21) Appl. No.: 11/969,197

(22) Filed: Jan. 3, 2008

(65) Prior Publication Data

US 2008/0282486 A1 Nov. 20, 2008

Related U.S. Application Data

(60) Provisional application No. 60/883,331, filed on Jan. 3, 2007.

(51) Int. Cl.
*F23J 3/00* (2006.01)

(52) U.S. Cl. ..... 266/235

(58) Field of Classification Search ..... 266/135
See application file for complete search history.

(56) References Cited

U.S. PATENT DOCUMENTS

| | | | | |
|---|---|---|---|---|
| 1,262,755 | A | 4/1918 | Cutler | |
| 3,258,256 | A * | 6/1966 | Brooke | 266/135 |
| 4,706,324 | A | 11/1987 | Goodspeed | |
| 5,000,260 | A | 3/1991 | Fontenot | |
| 5,542,650 | A | 8/1996 | Abel et al. | |
| 6,431,125 | B1 | 8/2002 | Eriksson | |
| 2005/0109370 | A1 | 5/2005 | Eriksson et al. | |
| 2007/0272130 | A1 | 11/2007 | Eriksson et al. | |

FOREIGN PATENT DOCUMENTS

| | | | |
|---|---|---|---|
| CA | 2462751 | C | 6/2007 |
| WO | 2007/136889 | A1 | 11/2007 |

* cited by examiner

*Primary Examiner*—Scott Kastler
(74) *Attorney, Agent, or Firm*—patenttm.us

(57) ABSTRACT

A spout opening cleaner for cleaning smelt spouts of recovery boilers and the like includes an actuation arm and self-aligning cleaning head. The cleaning head employs open bail designs for enabling continued flow of smelt during a cleaning cycle.

20 Claims, 18 Drawing Sheets

SMELT SPOUT OPENING CLEANER, CLEANING HEAD AND APPARATUS

This application claims priority of U.S. provisional patent application 60/883,331, filed Jan. 3, 2007.

BACKGROUND OF THE INVENTION

This invention relates to recovery boilers, and more particularly to devices and methods for cleaning the smelt spouts of recovery boilers.

A recovery boiler is used in the craft pulping process to burn the waste product that is generated when wood chips are converted to paper pulp. The waste product, called "black Liquor", is removed from pulp and pumped into a recovery boiler where it is burned. This combustion not only creates steam, which is used as an energy source, but also renders the black liquor down to its basic chemical elements, called smelt. The smelt, a mixture of molten sulfur and salts, decants from the bottom of the recovery boiler (at a temperature of approximately 1,600 degrees F.) through troughs located at the bottom of the boiler. These troughs are called smelt spouts. The smelt decants from the spouts, is hit with a scatter jet of steam or the like to help break the smelt into smaller size particles, which fall into a dissolving tank where it is mixed with warm water and subsequently referred to as green liquor. The green liquor is reconstituted, or fortified with more chemicals making it white liquor which is then placed back into a digester where it is mixed with woodchips to make more pulp and consequently transformed back into black liquor completing the cycle of green, white, and black liquor with smelt as an interim step between black and green.

The liquid smelt will solidify quite readily at temperatures below 1200 degrees F. and therefore, smelt as it decants from the smelt spout can and will become solid, restricting the flow of liquid smelt through the spouts. Traditionally the spouts have been kept flowing and operational by the boiler operations staff who periodically (approximately two to four times a shift (a shift might typically be 8 hours)) clean the spout trough and opening by scraping the spout with long lance type tool. A single boiler may have as many as six or as few as two smelt spouts. The spouts are trough shaped, typically 3-feet in length, about 6-inches inside width with a full radius bottom and extend from the bottom side (where the boiler floor meets the boiler wall) of a boiler at about a 15-degree angle.

Accordingly, there is an opportunity for an automated version of a spout cleaner.

SUMMARY OF THE INVENTION

In accordance with the invention, a new type of cleaning head and system is provided that can make automatic spout cleaning very inexpensive compared with prior art.

Accordingly, it is an object of the present invention to provide an improved smelt spout cleaning system and method.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises a cleaning head system for a smelt spout.

Figure 1:
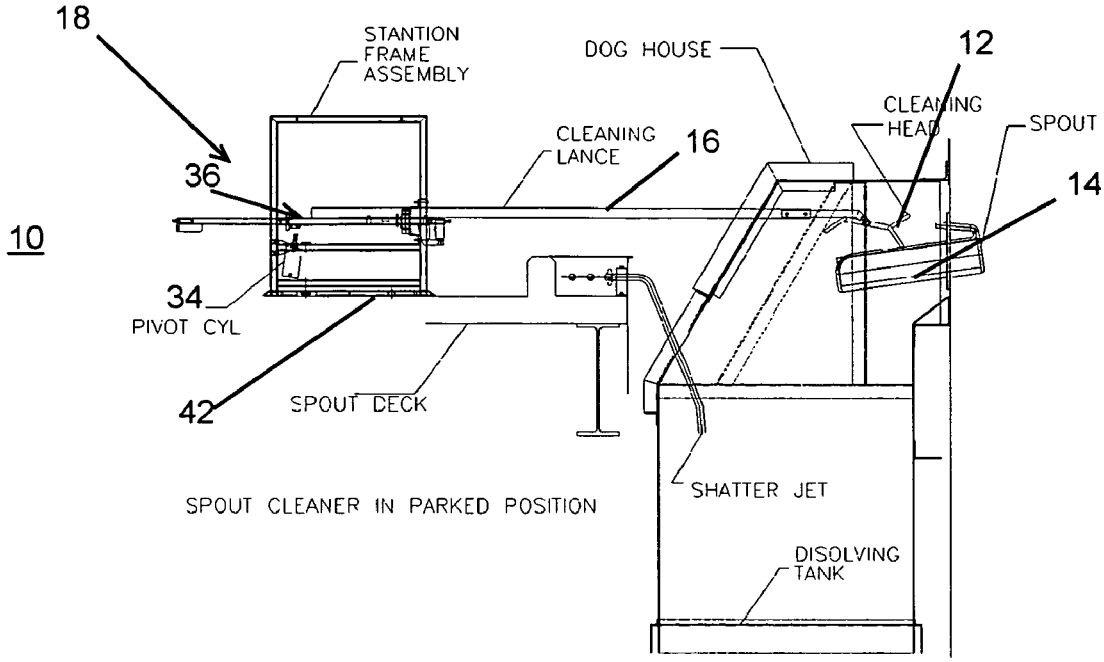
FIG. 1 is a schematic view of a system according to the invention.

Referring to FIG. 1, a schematic view of a system according to the invention, the spout opening cleaner 10 includes a cleaning head 12 device that is pushed and pulled through the spout trough 14 to clean it. The cleaning head attaches to the end of a cleaning lance 16. At the other end of the lance, well away from the spout is the main body 18 of the spout cleaner, comprising a frame work for the pneumatic air cylinders and electrical controls that supply the motive force and logic control for cleaning.

Figure 2:
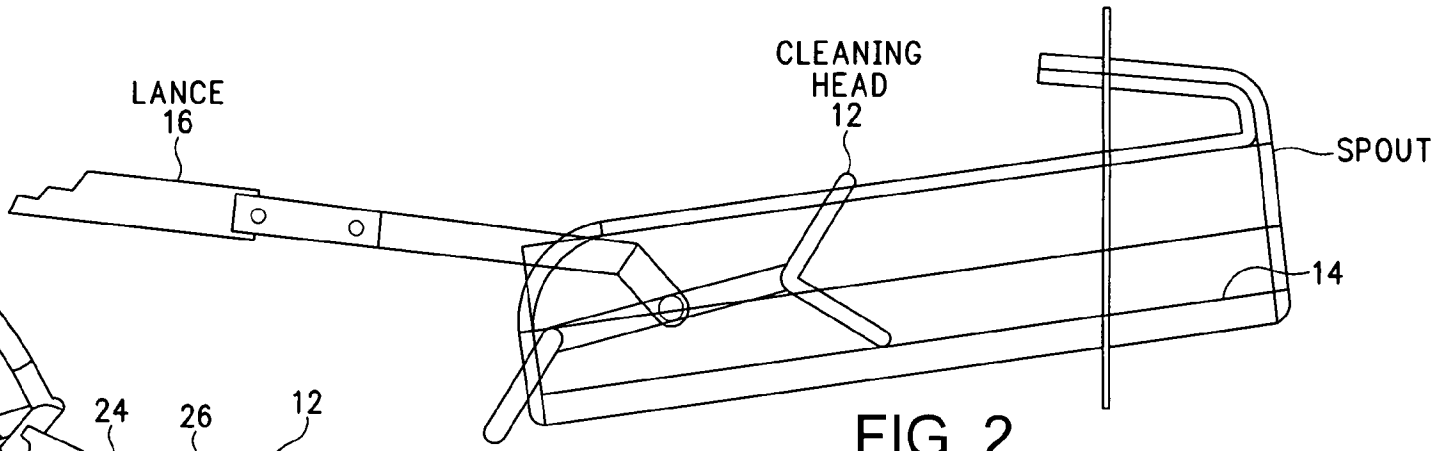
FIG. 2 is a side schematic view of the cleaning head at the start of a cleaning sequence.
Figure 3:
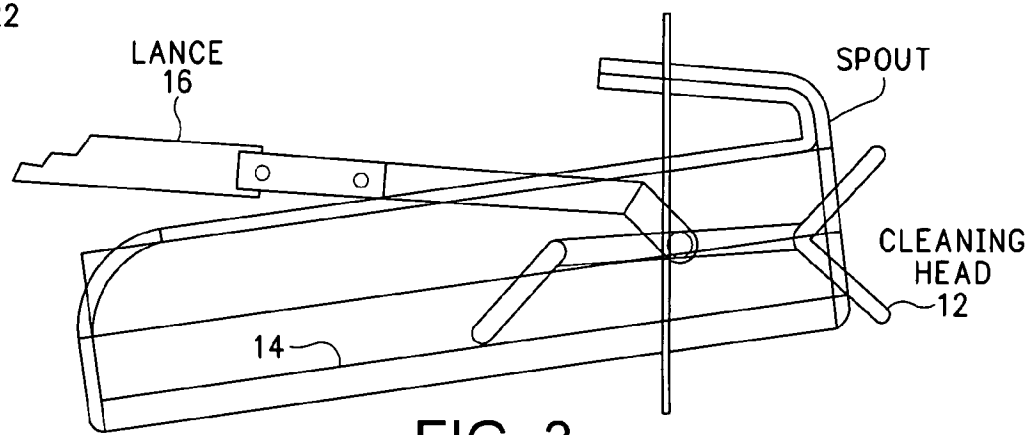
FIG. 3 is a side schematic view of the cleaning head near the maximum extension into the boiler during a cleaning sequence.

With reference to FIG. 2 and FIG. 3, the understanding of the cleaning motion helps convey the importance of the cleaning head design. Initially, the cleaning head is suspended in a parked position over the smelt spout. When the cleaning cycle begins the cleaning head is allowed to descend into the end (farthest from the boiler) of the smelt spout. Once the cleaning head is resting in the bottom of the spout the cleaning cylinder (via the lance) pushes the cleaning head up through the spout. The cleaning head is pushed then pulled back and fourth through the smelt spout, typically twice. The cleaning head is then raised out of the spout and back to its parked position. This cleaning motion will be repeated an adjustable amount of time but in a particular embodiment, for an example, about every 12 to 20 minutes. It is the design of the cleaning heads that makes this spout cleaning mechanism relatively inexpensive and reliable.

An advantageous feature of the cleaning head is that it employs an open bail design that permits smelt to flow through its interior when positioned in the spout, unlike other designs which could dam the flow smelt, creating problems, especially in the event of some type of mechanical failure where the cleaning head may become stuck in the spout.

Figure 4:
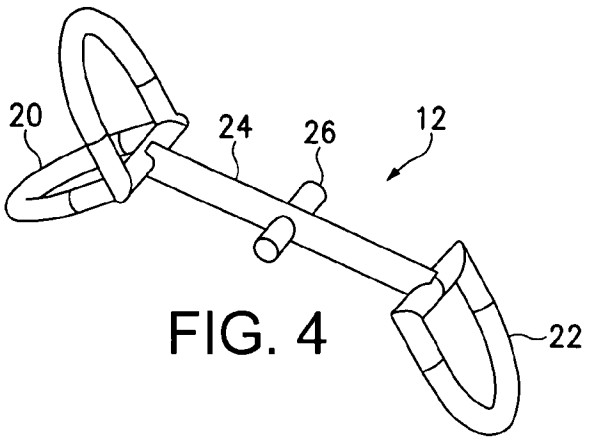
FIG. 4 is a perspective view of a cleaning head.

FIG. 4 is a schematic diagram of the cleaning head in accordance with a preferred embodiment of the invention. The cleaning head 12 has two or more bails to clean the smelt spout, one bail 20 mounted at the front of the cleaning head (closest to the boiler) and one bail 22 at the rear. More bales can be added between the front and rear if required. The advantage of plural bails is that a relatively long spout could be cleaned with a short amount of cleaning motion. For instance, two bales spaced 16 inches apart could clean 32 inches of spout with a 16 inch extent of cleaning motion; 3 bails at 16 inches equals 48 inches cleaned with a 16 inch cleaning stroke, etc.

The bails at the front the cleaner are angled (similar to a plow). When the tip encounters an obstruction, the angle tends to force the tip down into the bottom of the smelt spout trough. The bail at the front of the cleaning head is angled to take advantage of the plow effect while being pushed into the boiler and the bail at the rear of the cleaning head is angled in an opposite direction (compared to the front bail) to take advantage of the plow effect when the tip is withdrawn from the boiler.

The bails are formed so that they match, or correspond to the shape of the bottom of the spout trough.

Another advantageous feature to the cleaning head is that it is permitted to float in its mounting. The pivoting mounting system that connects the cleaning head to the lance is very loose. This loose mounting not only enables the cleaning heat to pivot, but also enables a substantial amount of axial translation of the cleaning head, allowing the cleaning head to "find" the bottom of the smelt spout when cleaning. Additionally, the floating design reduces installation time because accurate and therefore extensive alignment is not necessary.

As may be observed in FIG. 4, all the surfaces on the cleaning head are suitably rounded. As smelt solidifies, it will stick and pile up onto flat surfaces. Accordingly by avoiding the use of flat surfaces, this problem is reduced or avoided. Employing round surfaces on the bails also prevents undue wear on the spout.

The cleaning heads are mounted at opposite ends of a central bar 24 which has two pivot pins 26 extending away therefrom at suitably a right angle to the longitudinal axis of the bar.

Figure 5:
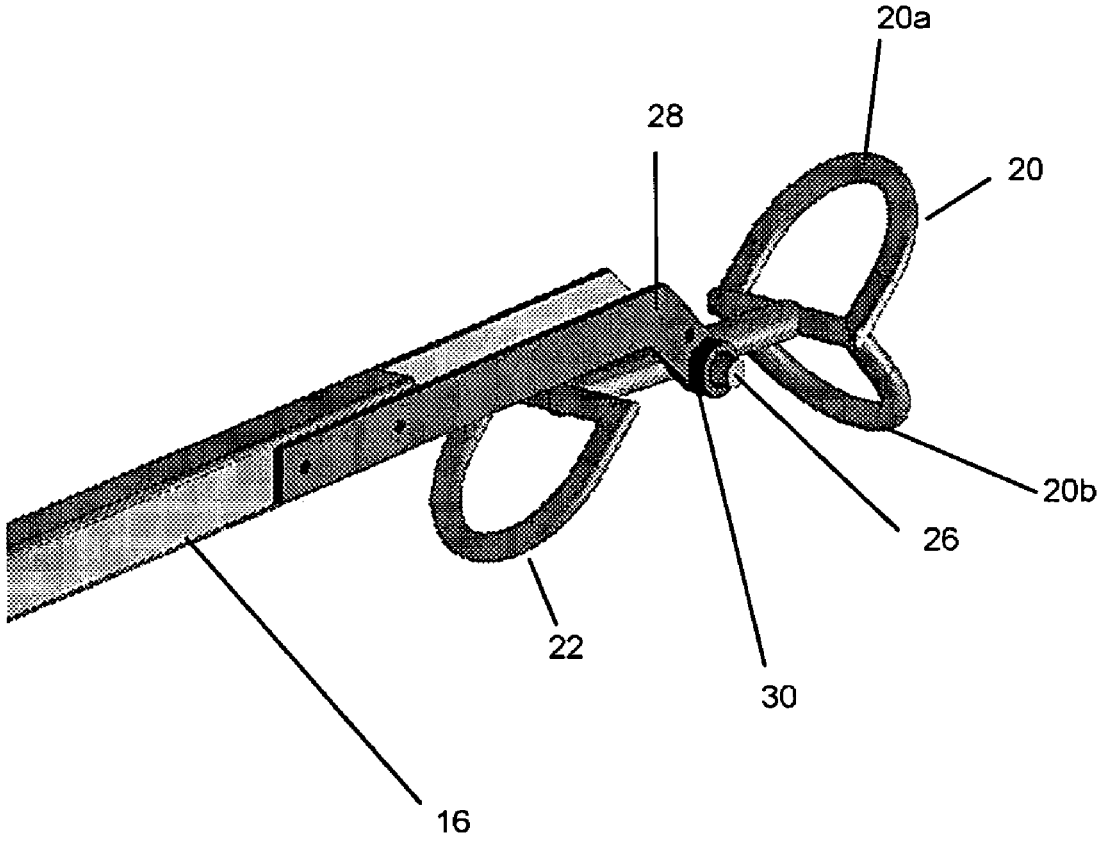
FIG. 5 is a view of the cleaning head as mounted to the lance.

Referring to FIG. 5, the cleaning head mounts to the lance 16 by mounting arms 28, which extend out from the lance and, at an end distal from the lance, extend downwardly at an angle, e.g. 45 degrees. Pivot sockets 30 are carried on the distal end of the mounting arms to receive pins 26 therein, enabling the central bar 24 and therefore the cleaning head to rotationally pivot about the central axis of the pins. Such action, enables the cleaning head to self-align and adapt to find the bottom of the smelt spout during a cleaning operation.

In the configuration of FIG. 5, the upper bail 20*a* provides cleaning action to interact with obstructions at the smelt spout opening, while the lower bail 20*b* and bail 22 are adapted to clean the bottoms and sides of the spout.

Another feature provided by the invention is that after the cleaning head is raised from the spout, it will strike a rigidly mounted anvil whenever the head is returned to the "Parked" position in the cleaning sequence. This further assists to keep the cleaning head clean and free of any smelt that may have adhered during the cleaning sequence.

In a particular embodiment, the cleaning head material is a ¾-inch diameter, 400 series stainless steel. The 400 series, or more specifically stainless steels with high amounts of Chromium alloy and relatively small amounts of nickel, is advantageous in this application as nickel is negatively affected when in contact with smelt.

Figure 6:
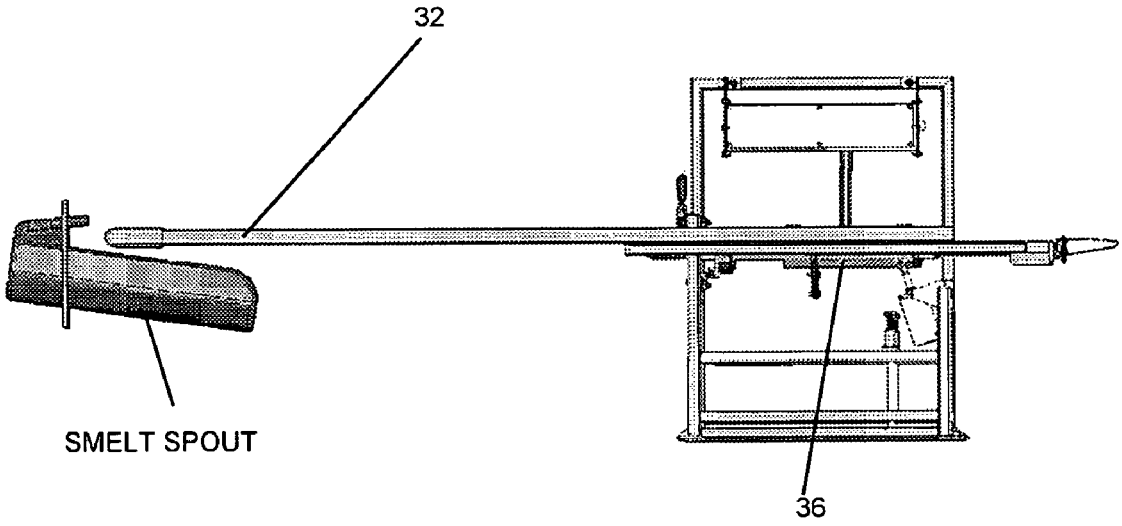
FIG. 6 is a view of an alternate lance attachment for clearing a substantially blocked smelt spout.

Referring to FIG. 6, a view of an alternate lance attachment for use in clearing a smelt spout, an alternate lance 32 may be attached to the device, with a small tip adapted to act in a punch like manner to break open a substantially clogged smelt spout.

In accordance with the inventions, and improved smelt spout cleaning system and method are provided. The cleaning begins by lowering the cleaning head into the trough of the smelt spout (by use of the pivot cylinder 34 of FIG. 1), wherein the downward force of the cleaning head against the spout is adjustable. The cleaning cylinder 36 (visible in FIG. 6) pushes the cleaning head up the spout and just beyond the spout opening, inside the boiler. Any build-up within the spout trough and/or blockage at the spout entrance is broken up and carried away. The cleaning cylinder then reverses its motion. Because of the matching cleaning head profile to that of the smelt spout trough, only two cycles are typically required. The lance and cleaning head then return to their default "parked" position.

Figure 7:
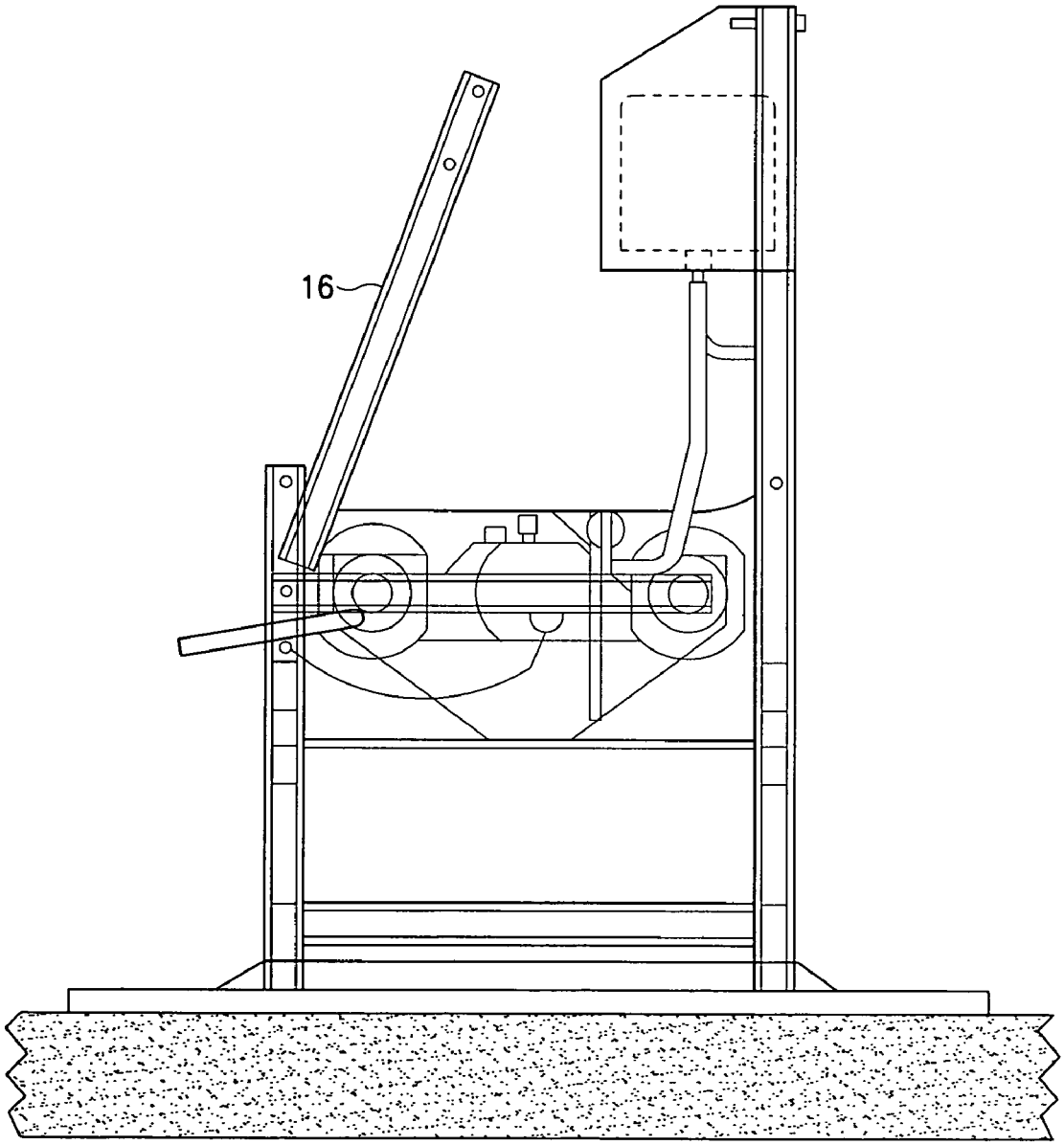
FIG. 7 illustrates a view of the device with the cleaning arm folded.

FIG. 7 illustrates the cleaner in a "dormant" position, wherein a portion of the cleaning arm lance 16 is folded upwardly to be out of the way. The dormant or inactive condition is particularly helpful when additional hand rodding of the smelt spout is required or when boiler start-up is taking place.

Figure 8:
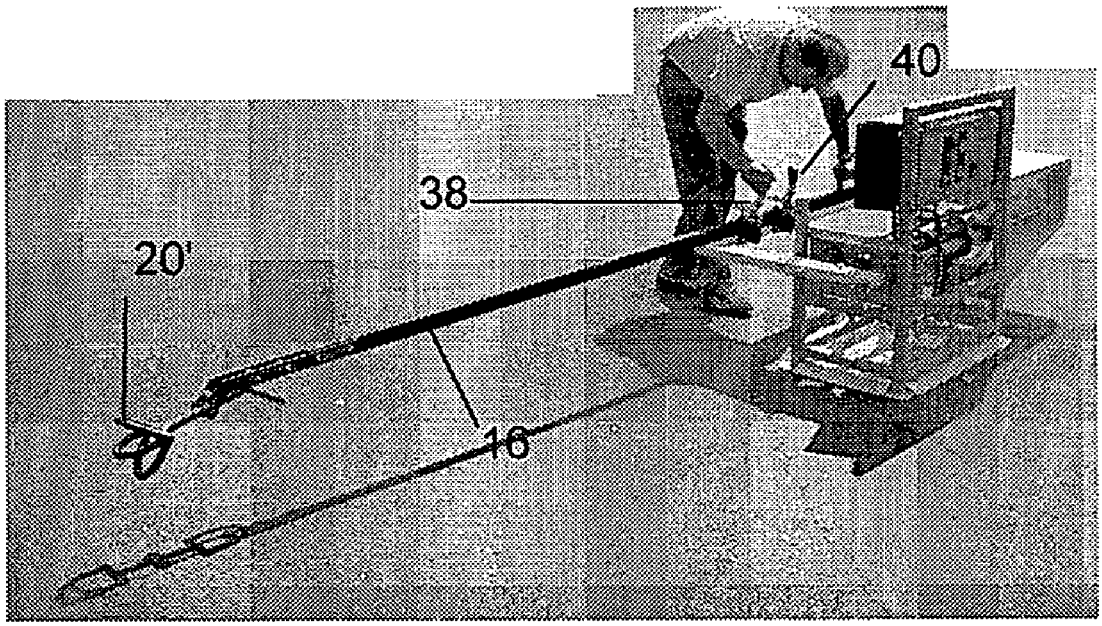
FIG. 8 is a perspective view of the device.

FIG. 8 is a view of the cleaning device showing the offset nature of the cleaning arm lance 16. Having the arm positioned at the side of the actuation mechanics locates the cleaner's components out of line with the smelt spouts. In the view of FIG. 8, and alternate cleaning head 20' is provided, wherein the front end thereof has both upper and lower portions 20*a*, 20*b*, as well as a center portion 20*c*.

The cleaning lance is removed from the main portion of the unit by releasing two toggle clamps 38, 40, whereupon the lance arm can now be folded into an up-right (dormant) position as in FIG. 7.

Figure 9:
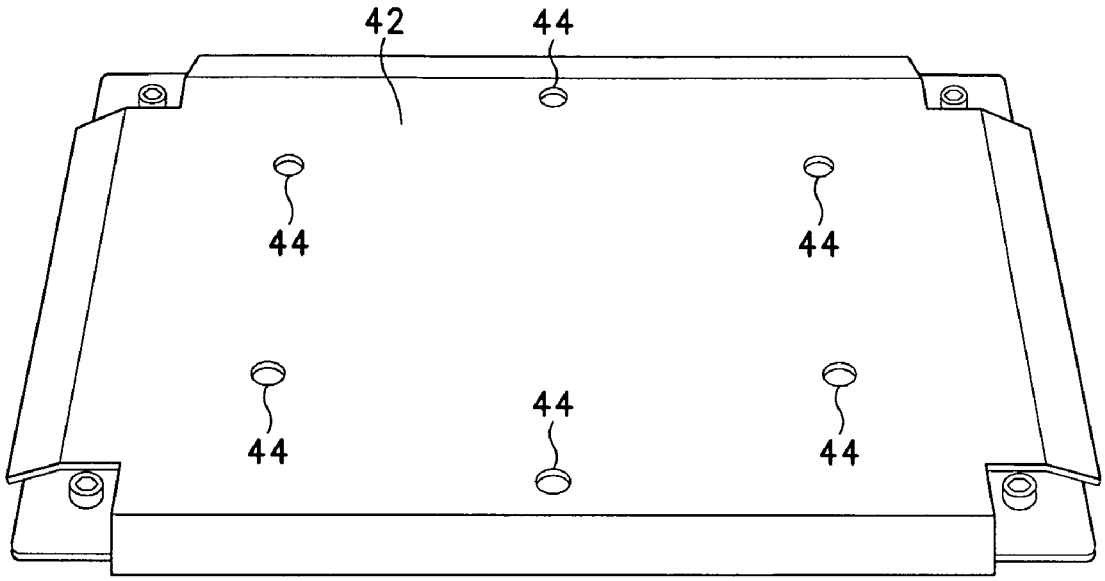
FIG. 9 is a view of a mounting deck plate.

Referring to FIG. 9, view of a floor mounted deck plate, 42, the deck plate includes mounting holes 44 thereon, and the spout cleaning mechanism is suitably releasably mountable to the deck plate by use of spring loaded deck bolts or pins which interact with the deck plate. The deck plate is preferably mounted to the smelt spout deck plate and remains there, even if the spout cleaner mechanism is removed for maintenance or other reasons. This enables repeated and consistent locating of the spout opening cleaner. The device can therefore be removed and moved away from the smelt spout for maintenance or the like.

The device is suitably pneumatically powered and also employs electrical controls for operation thereof, and quick-disconnect air and electrical supplies are provided. Two separate alarm functions provide feedback relative to problem at hand.

Indicator light provides visual feedback for system air supply. Audible alarm is provided in the event the spout opening cleaner does not return to the "parked" position after initiating a cleaning cycle (i.e. stuck in the boiler) and an "Alarm Silence" button is provided to disable audible alarm. In a typical use of the device, plural spout opening cleaners are provided (as the recovery boiler has plural smelt spouts) and each spout opening cleaner has its own control system in the preferred embodiment, to allow for cycle times to be adjusted independently, for each unit. However, plural units may also be operated together under a single control, if desired.

Figure 10A:
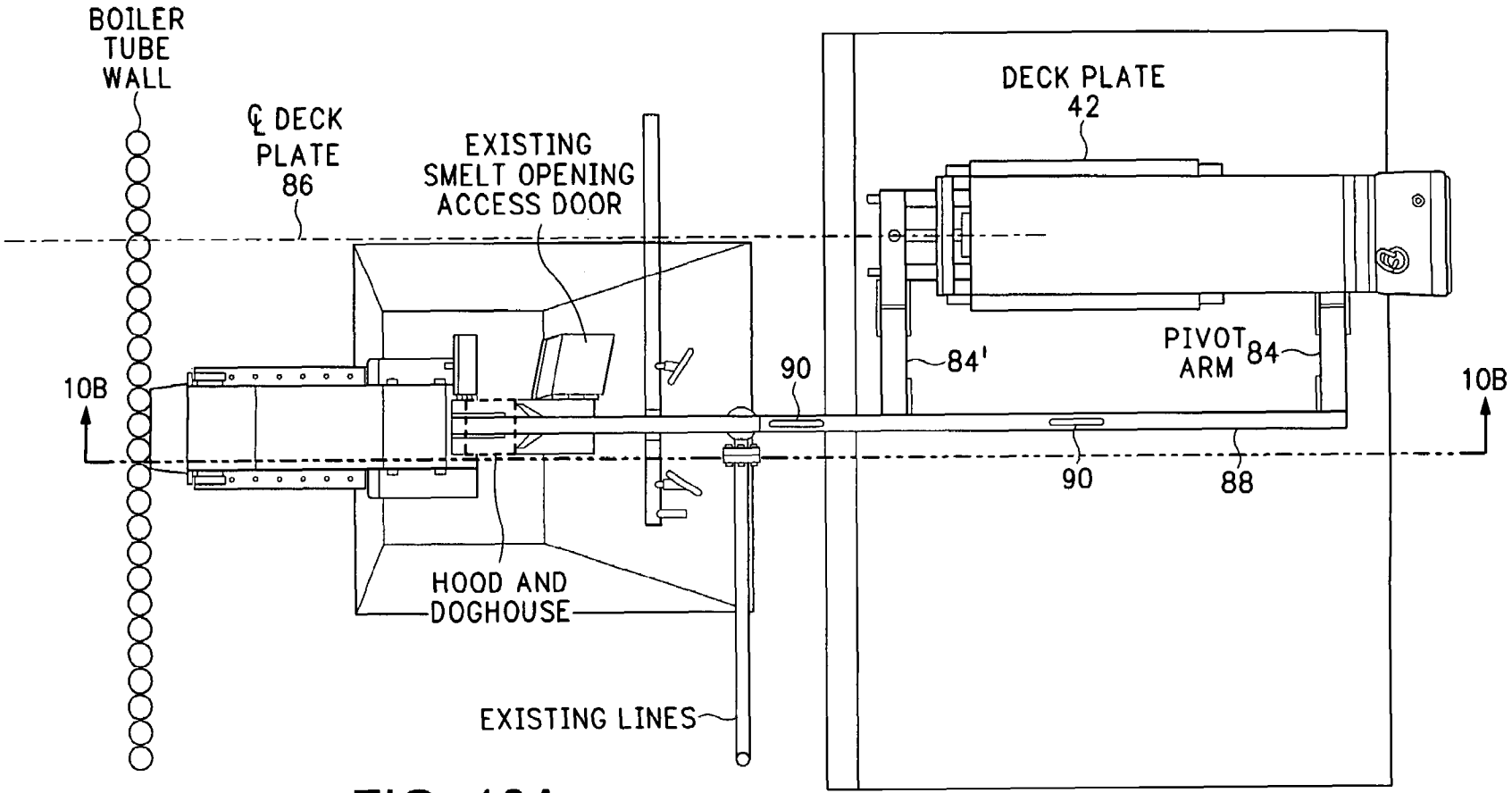
FIG. 10A is a top schematic view of an alternate system according to the invention.

Referring now to FIG. 10A, a top view of an alternate embodiment cleaning device 12' as installed at a recovery boiler, the placement thereof via deck plate 42 is such that the cleaning arm portion may be folded via pivot arm 84, 84', that enables pivoting of the arm portion upwardly and in a direction toward the centerline 86 of the deck plate so as to be movable out of the way of the smelt spout area for easy access thereto, should manual access be needed, for example in case of upset of the furnace or during shutdown. Lance arm 88 is provided with plural handles 90 for ease of carrying for installation and removal thereof. The lance arm mounts to the cleaning mechanism via pins, for example, for quick removal and installation thereof.

Figure 10B:
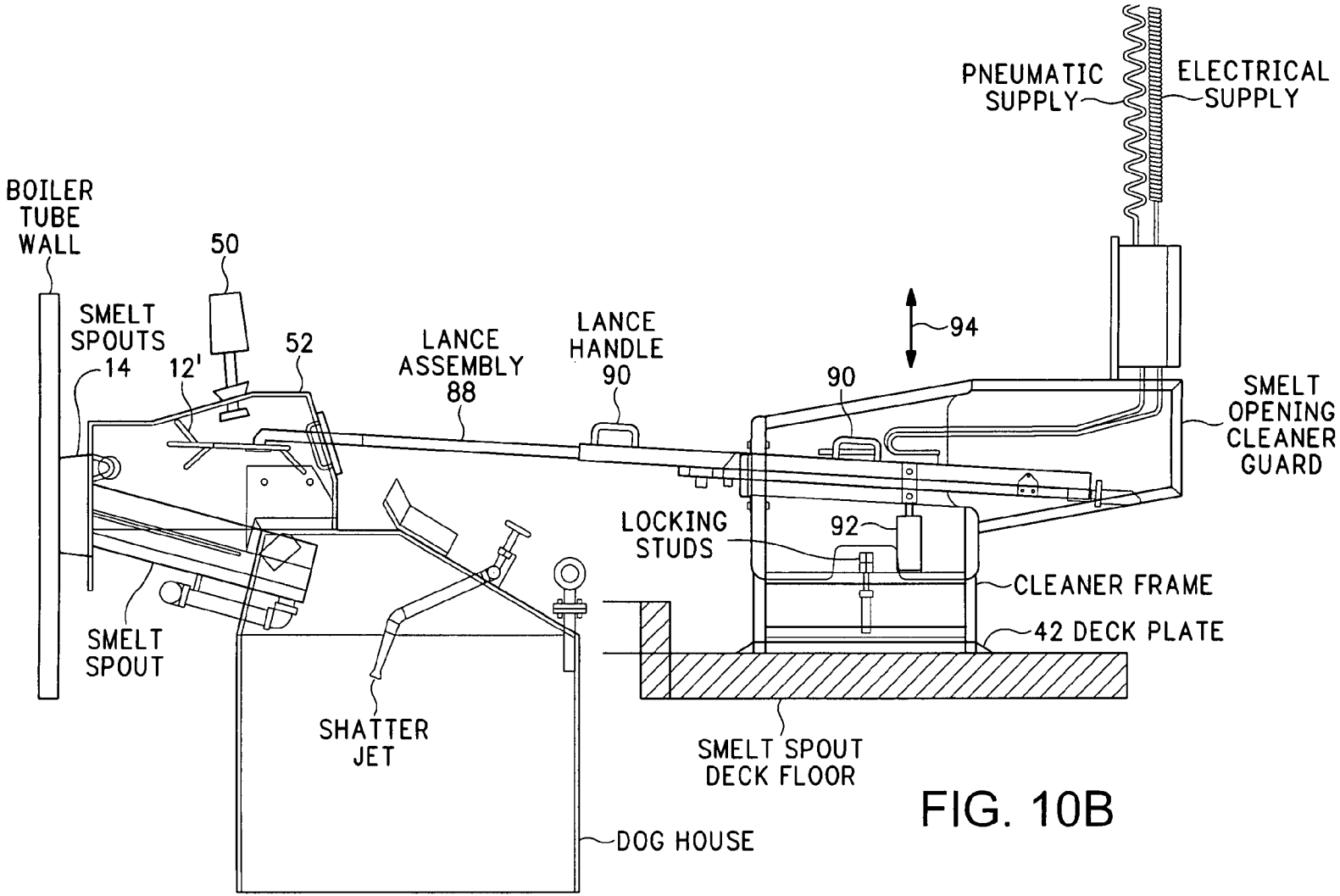
FIG. 10B is a side sectional view of an alternate system of FIG. 10A, taken along line 10B-10B.
Figure 11:
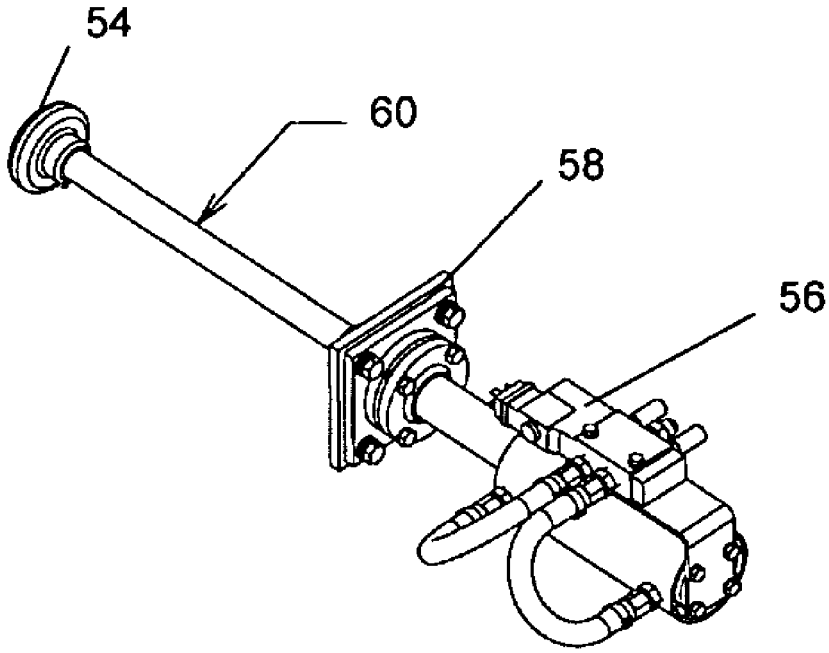
FIG. 11 is a view of a rapping device installable on the dog house or smelt spout cover.

Referring to FIG. 10B, a side sectional view of a cleaning system in accordance with the invention as installed at a recovery boiler, taken along line 10B-10B of FIG. 10A, in this configuration, a rapping device 50 is mounted to the dog house 52, in a position above the smelt spout the purpose of knocking solidified smelt from the cleaning head. The rapping device 50, illustrated in greater detail in FIG. 11, comprises a hammer head 54 mounted to the end of a pneumatic cylinder 56. The cylinder is mounted to the doghouse or smelt spout cover (a metal cover or housing that covers the spout) via mounting bracket 58 and periodically is actuated to repeatedly strike the cleaning head 12' to remove any accumulated smelt therefrom. Alternatively, a non-actuated anvil member may be provided in a corresponding location, wherein the cleaning head 12' is caused to strike the anvil member by operation of the cleaning mechanism. In place of the pneumatic cylinder 56 that actuates the hammer head member, a counterweight is provided.

The length of the actuation arm 60 may be adjusted at installation to provide the optimal length, as the distance from the mounting position on the dog house to provide the desired striking of the cleaning head may vary from installation to installation, as the configuration and dimensions of the various components and their locations can vary from site to site.

A hydraulic actuator 92 mounted within the cleaning device frame operatively acts with the cleaning mechanism to raise or lower the lance arm in the direction of arrow 94.

Pneumatic and electrical supply lines are suitably provided to power the hydraulics and controls.

Figure 12:
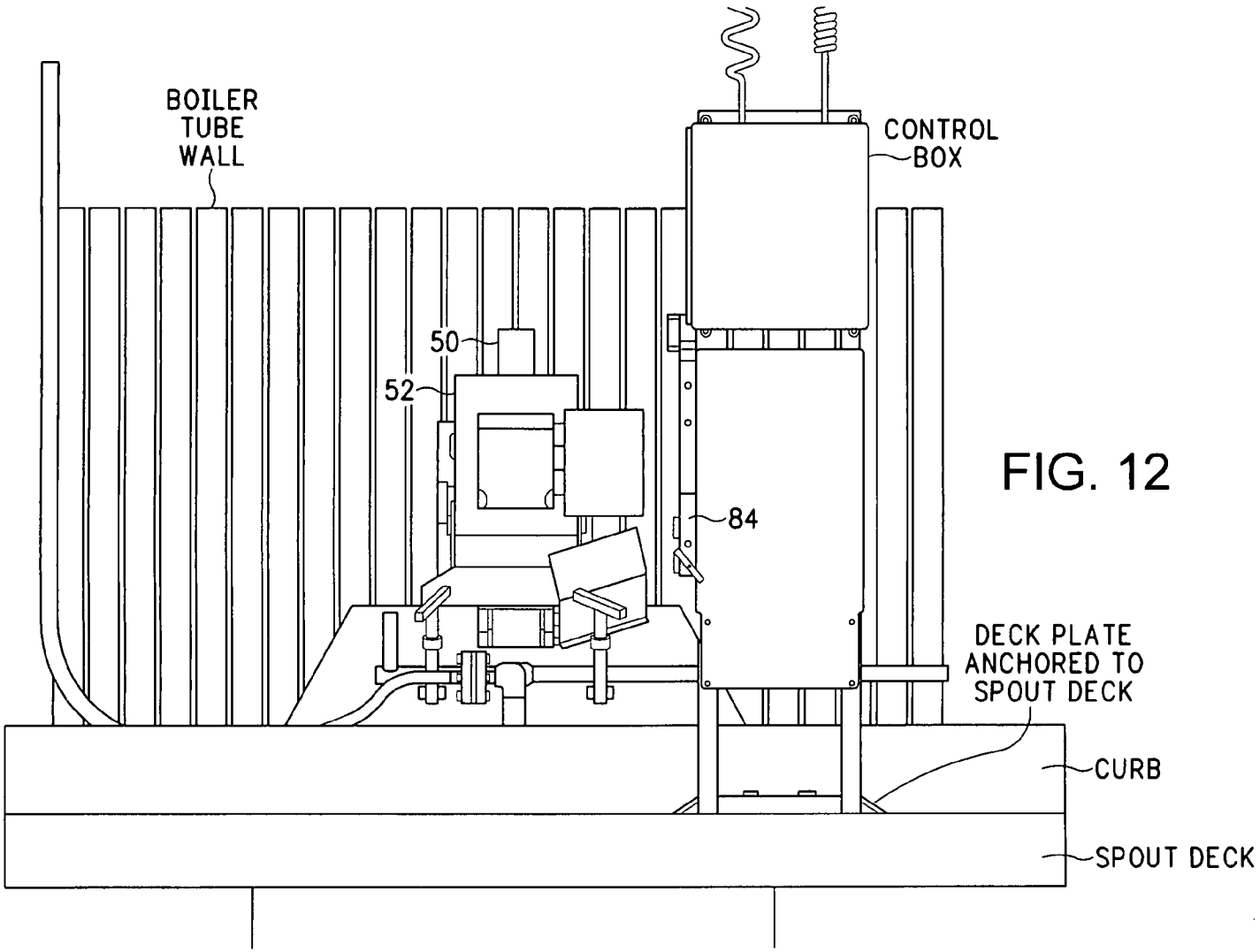
FIG. 12 is a rear view of the device as installed at a recovery boiler, with the pivot arm pivoted upwardly to be out of line with the smelt spout.
Figure 13:
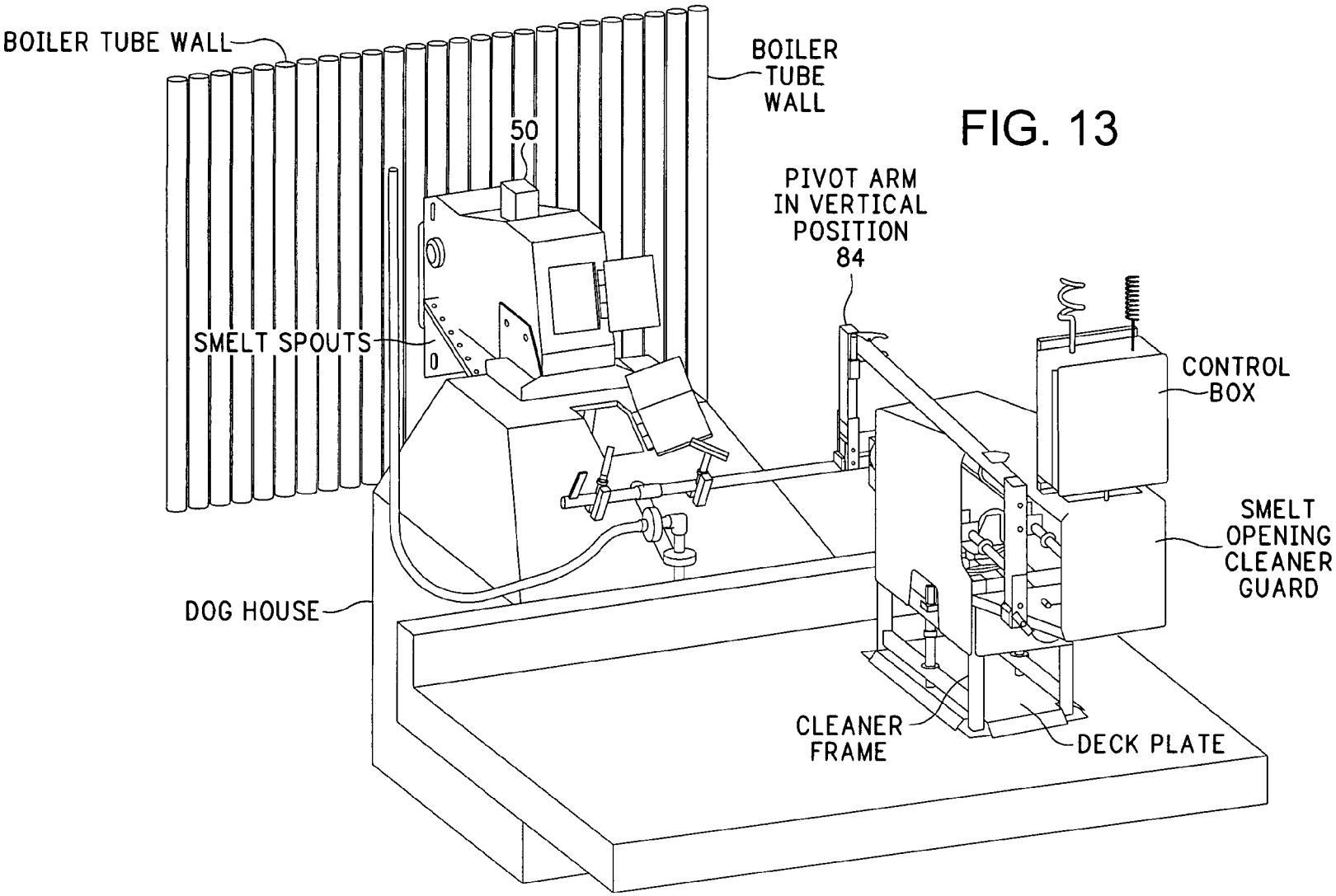
FIG. 13 is a rear perspective view thereof.

Referring to FIGS. 12 and 13, rear and rear perspective views of the device as installed, the device provides an off-set and folding design, where the cleaner resides on the spout deck (that portion of the boiler building floor immediately in front of the spout openings) between the spouts. When not in use, the cleaning lance can be removed and actuation pivot arms 84 folded into a dormant position to allow unencumbered access by the boiler operators to the spouts during boiler start-up and/or upset conditions.

A part of this folding design provides the ability to employ a removable lance with cleaning head. The lance may be retained with quick release toggle clamps, or mounting pins, to enable the lance to be quickly and easily removed.

The cleaning device can quickly and easily be removed and/or installed on the spout deck. This is made possible with the use of the deck plate (FIG. 9) which provides locating pockets that interact with corresponding pins on the frame of the cleaning device, whereby the cleaner is simply dropped into its correct location on the deck plate. When the cleaner is removed the deck plate suitably remains in position, but has a very low profile with sloped or beveled sides to reduce any tripping hazard.

Figure 14:
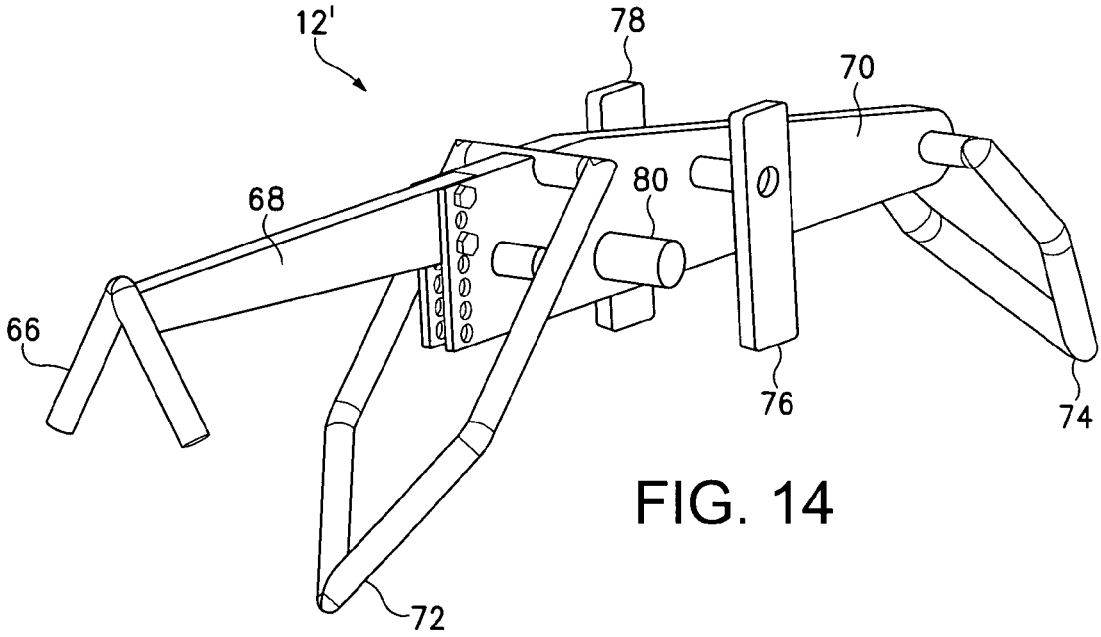
FIG. 14 is a perspective view of an exemplary cleaning head.
Figure 15:
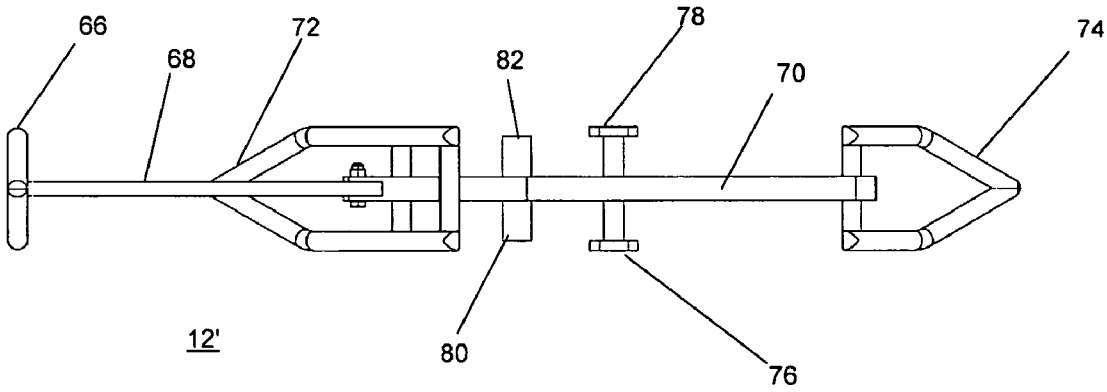
FIG. 15 is a top view thereof.

Referring to FIGS. 14 and 15, perspective and top views of a particular embodiment of a cleaning head 12', the cleaning head can comprise a single piece unit comprised of a front bail 66, having the form of an inverted open V in the illustrated embodiment, mounted on an elongate member 68 forwardly of a main spine body 70. Forward and rearward bottom bails 72, 74, having V-shaped profiles, mount projecting downwardly at front and rear ends of main body 70. These particular bail shapes are adapted to conform to a particular smelt spout profile having a more angular spout cross section shape, whereas, the curved configuration bails could be employed in the case of a more curved profile spout. Other configurations to conform to a particular spout profile may also be employed.

Somewhat centrally of the main body 70, side scraper bars 76, 78 are mounted on opposite sides of the body.

Mounting pins 80, 82 are provided on opposite sides of the main body 70 to enable quick release mounting to the lance arm.

The main spine body is suitable constructed of bar or plate, making replacement of the bails possible by relatively easy bolting or welding of the bails thereto.

In operation, the cleaning head is inserted towards the smelt spout. The top bail 66 will enter the spout opening first, typically cleaning the upper portion of the spout opening into the boiler, followed by the bottom bails. This reduces the amount of force required to clean, as initially only the front bail is in cleaning. The side scraper bars provide further cleaning of areas that the bails might not otherwise cover.

Whereas the front bail or bails clean both the smelt spout trough and spout opening and the rear bail cleans not only the spout trough, but importantly, the rear bail will clean the decanting edge or front lip 64 of the spout (FIG. 10). The cleaning head suitably resides above the spout in a horizontal or nearly horizontal position. The head aligns itself to the spout only when placed in the spout. The entire cleaning head rotates about its pivot (front up and rear down) to conform to the spout angle.

The mounting is open bearing or bushing on either side of the head to allow rotation and axial translation. The cleaning head configuration is such that it finds the spout, without requiring specific adjustment or calibration.

In a specific configuration, at least the bail (and optionally side scraper bars) of the cleaning head 12, 12' are manufactured from alloys containing 28% chromium or greater.

Figure 16:
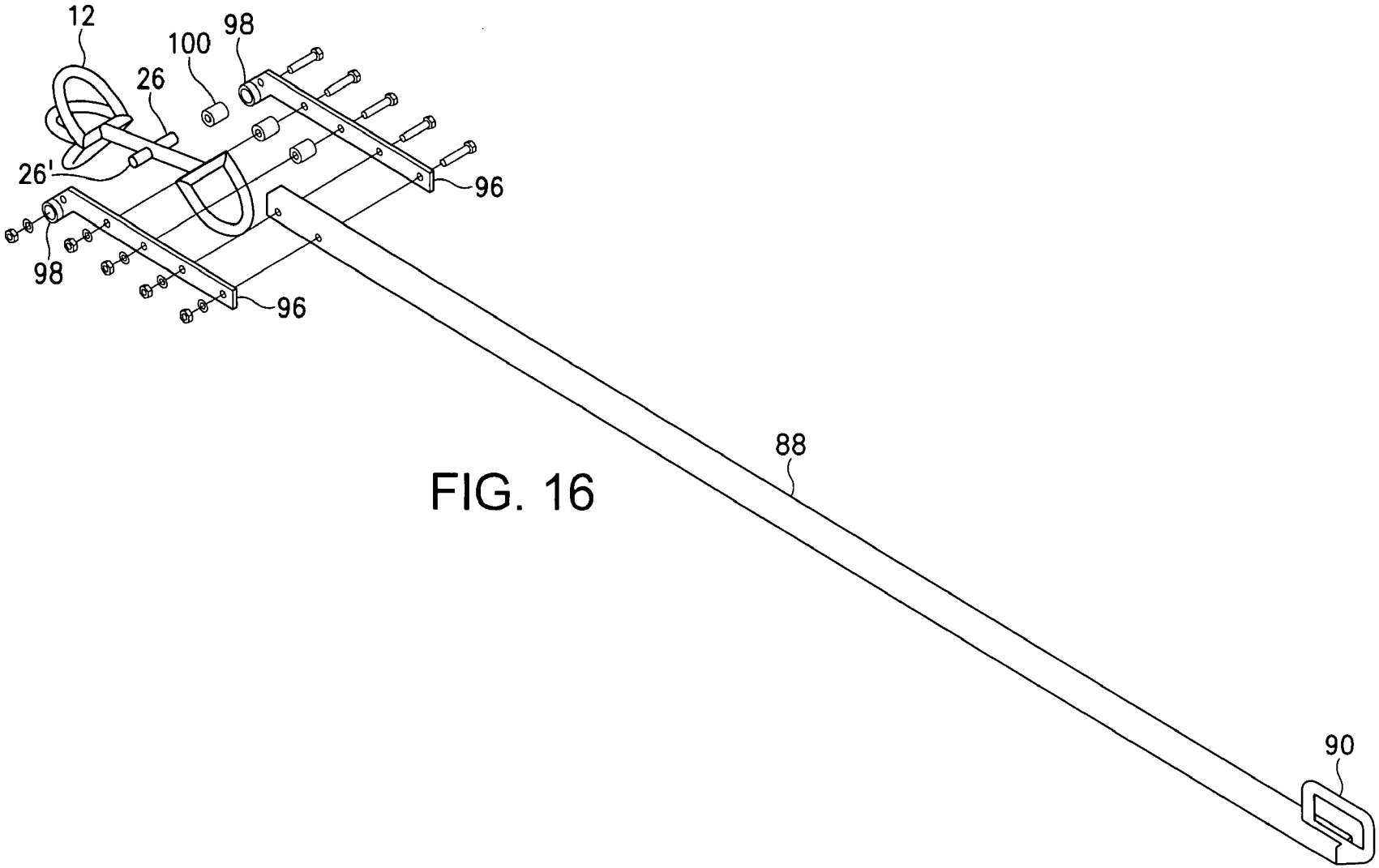
FIG. 16 is a view of a manner of mounting the cleaning head to the lance arm.

Referring to FIG. 16, a manner of mounting the cleaning head to the lance arm is illustrated. Brackets 96 including mounting holes that correspond to mounting holes on the end of the lance arm, to receive bolts or the like therethrough, to attach the brackets to the lance arm. The forward end of the brackets away from the lance arm extend downwardly slightly and include pivot socket openings 98 adapted to receive the pins 26, 26' of the cleaning head therein. Spacers 100 may be employed as necessary to provide optimal rigidity to the mounting.

Figure 17:
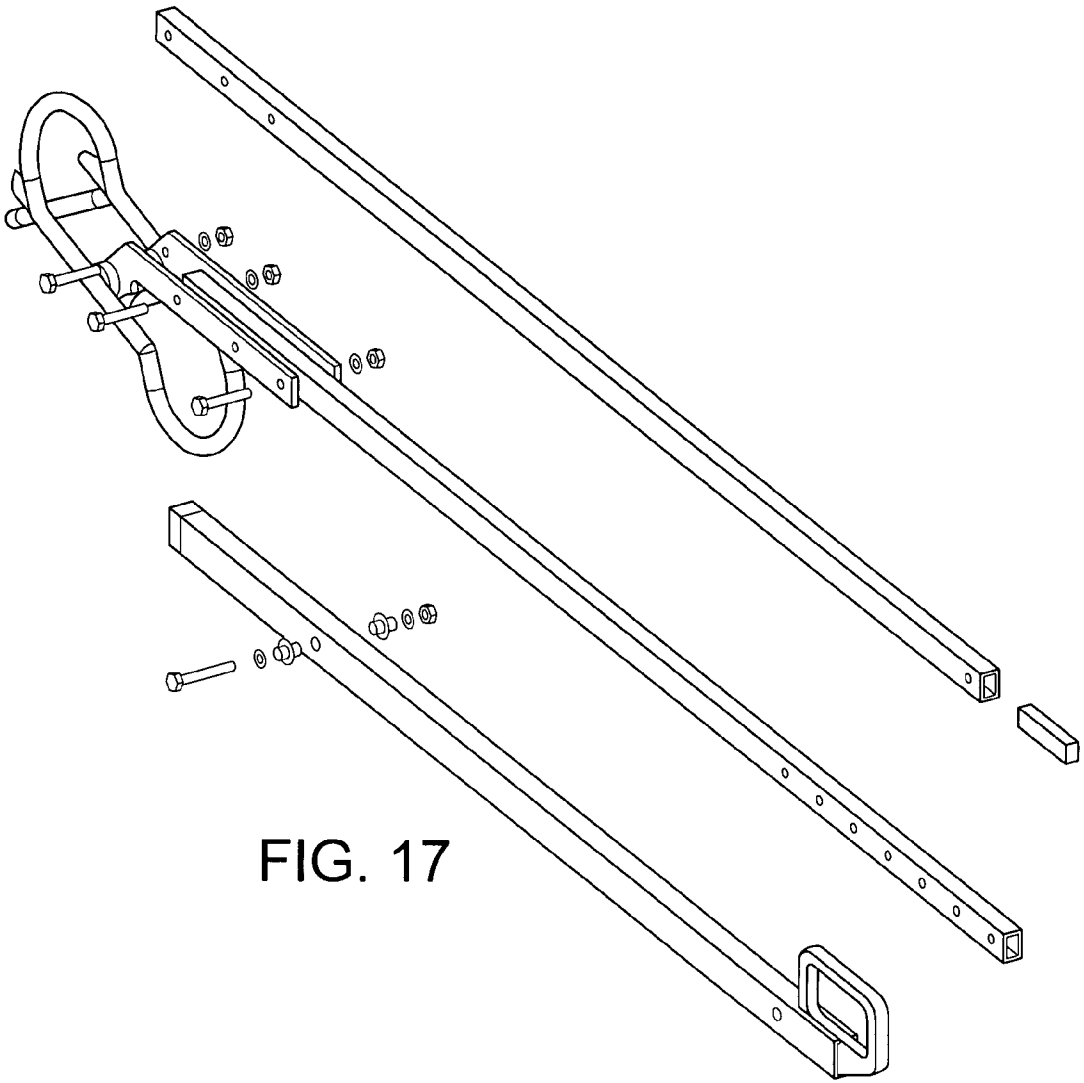
FIG. 17 illustrates an alternative lance arm configuration.

FIG. 17 illustrates an alternative lance arm configuration, with extension members to enable adjustment of the length thereof to accommodate different configurations of recover boilers.

Figure 18:
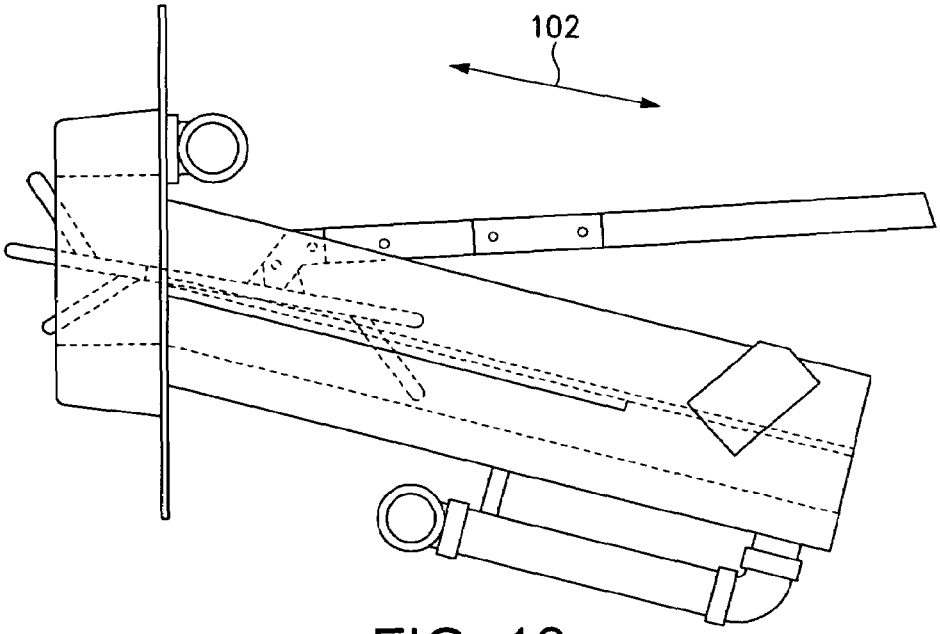
FIGS. 18-20 illustrate exemplary cleaning head motion.
Figure 19:
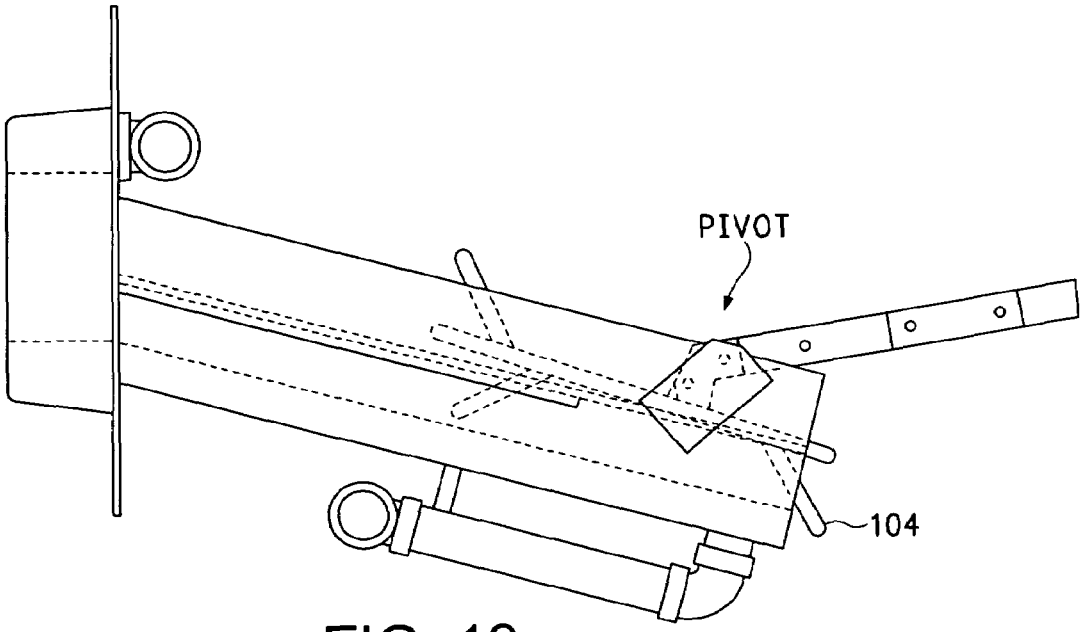
Figure 20:
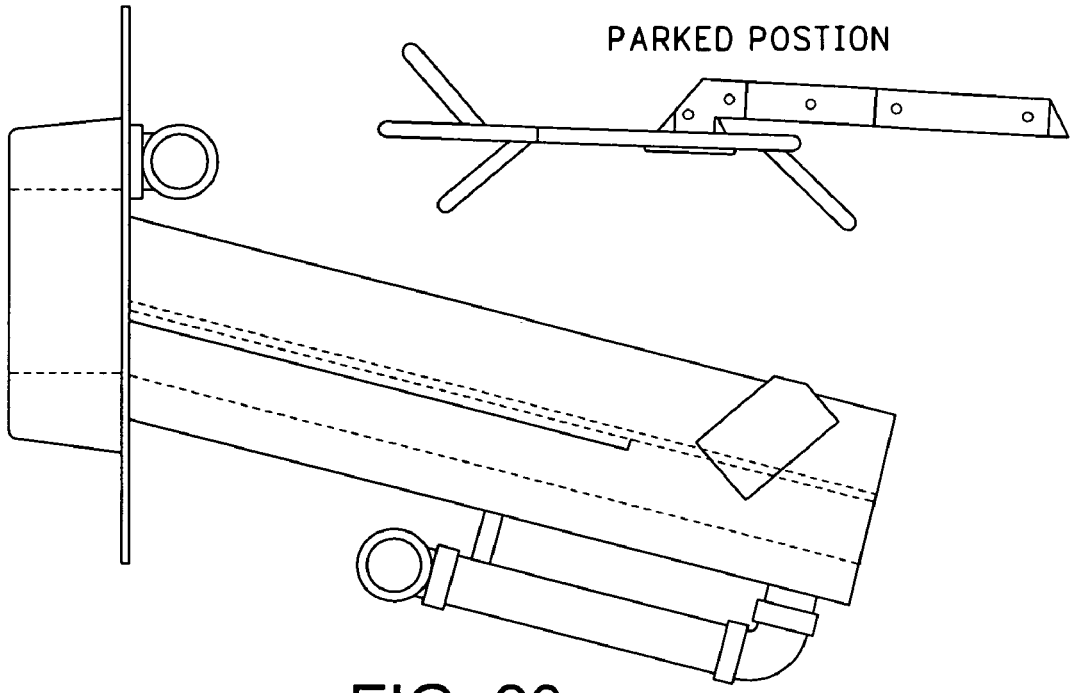

FIGS. 18-20 illustrate cleaning head motion. In FIG. 18, it may be observed that the cleaning head may be moved upwardly and downwardly along the spout as shown by arrow 102. The pivotal mounting of the cleaning head to the lance arm enables the cleaning head to pivot and conform to the spout angle, and, allows the lower bail 104 to pivot and clean along the lower lip portion of the spout, to remove buildup thereon which might otherwise interfere with the efficient operation of the scatter jet. FIG. 20 illustrates the cleaning head location in a parked position, up and away from the spout, when between cleaning cycles.

In operation, the device is mounted to the deck plate 42, the pivoting arm is folded down to the configuration of FIG. 10B, the lance arm is installed thereon to the desired length, with the cleaning head mounted at the distal end of the lance arm. The head is initially in the parked position of FIG. 20, and upon actuation, pneumatic cylinders in the device cause the lance arm to extend (and raise or lower as desired) so that the upper bail 66 inserts into the smelt spout opening of the furnace, cleaning the upper portion thereof. The lower bails are then allowed to travel in the trough of the smelt spout as in FIGS. 18 and 19, while the lance arm is retracted and extended to accomplish cleaning. The cleaning head may be positioned under the device 50 so that head 54 will strike the cleaning head on actuation of pneumatic cylinder 56, which will operate to remove built up smelt debris that might collect on the cleaning head.

When a cleaning cycle is completed, the cleaning head may be parked in the position of FIG. 20. Also, as noted above, the lance arm can be removed and the actuation arms of the device folded up so as to be out of the way and provide a more open access to the smelt spout if necessary.

While plural and preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A smelt spout opening cleaner, comprising:

a lance arm adapted for insertion and removal relative to a smelt spout; and a self-aligning cleaning head mounted to said lance arm for effecting a cleaning of the smelt spout during the insertion or removal of said lance arm, wherein said cleaning head comprises a body having a front bail, having the form of an inverted open V, and forward and rearward bottom bails, having V-shaped profiles, mount projecting downwardly relative to said front bail.

2. The smelt spout opening cleaner according to claim 1, wherein at least one of said forward and rearward bottom bails comprises an open bail portion to effect cleaning without substantially blocking flow of smelt.

3. The smelt spout opening cleaner according to claim 1, wherein said cleaning head body comprises a single piece unit.

4. The smelt spout opening cleaner according to claim 1, further comprising left and right spout side scraper bars mounted on opposite sides of the cleaning head body.

5. The smelt spout opening cleaner according to claim 4, wherein at least one of said left and right spout side scraper bars comprises rectangular members mounted to be spaced away from said cleaning head body.

6. The smelt spout opening cleaner according to claim 1, wherein said front bail is mounted to said cleaning head body via an elongate member extending forwardly of said body.

7. The smelt spout opening cleaner according to claim 1, wherein said forward and rearward bottom bail shapes are adapted to conform to a smelt spout profile.

8. The smelt spout opening cleaner according to claim 1, wherein mounting pins are provided on opposite sides of said cleaning head body to enable quick release pivotal mounting to said lance arm.

9. The smelt spout opening cleaner according to claim 1, wherein said forward and rearward bottom bails comprises alloys containing 28% chromium or greater.

10. The smelt spout opening cleaner according to claim 1, wherein said front bail comprises alloys containing 28% chromium or greater.

11. A smelt spout opening cleaner, comprising:

a lance arm adapted for insertion and removal relative to a smelt spout; and a self-aligning cleaning head mounted to said lance arm for effecting a cleaning of the smelt spout during the insertion or removal of said lance arm, wherein said cleaning head comprises a body having a front bail, having the form of an inverted U, and forward and rearward bottom bails, having U-shaped profiles, mount projecting downwardly relative to said front bail.

12. The smelt spout opening cleaner according to claim 11, wherein at least one of said forward and rearward bottom bails comprises an open bail portion to effect cleaning without substantially blocking flow of smelt.

13. The smelt spout opening cleaner according to claim 11, wherein said cleaning head body comprises a single piece unit.

14. The smelt spout opening cleaner according to claim 11, further comprising left and right spout side scraper bars mounted on opposite sides of the cleaning head body.

15. The smelt spout opening cleaner according to claim 14, wherein at least one of said left and right spout side scraper bars comprises rectangular members mounted to be spaced away from said cleaning head body.

16. The smelt spout opening cleaner according to claim 11, wherein said front bail is mounted to said cleaning head body via an elongate member extending forwardly of said body.

17. The smelt spout opening cleaner according to claim 11, wherein said forward and rearward bottom bail shapes are adapted to conform to a smelt spout profile.

18. The smelt spout opening cleaner according to claim 11, wherein mounting pins are provided on opposite sides of said cleaning head body to enable quick release pivotal mounting to said lance arm.

19. The smelt spout opening cleaner according to claim 11, wherein said forward and rearward bottom bails comprises alloys containing 28% chromium or greater.

20. The smelt spout opening cleaner according to claim 11, wherein said front bail comprises alloys containing 28% chromium or greater.

* * * * *